United States Patent [19]

Iwasaki

[11] 4,164,718

[45] Aug. 14, 1979

[54] ELECTROMAGNETIC POWER ABSORBER

[75] Inventor: Richard S. Iwasaki, Los Angeles, Calif.

[73] Assignee: California Institute of Technology, Pasadena, Calif.

[21] Appl. No.: 834,257

[22] Filed: Sep. 15, 1977

Related U.S. Application Data

[63] Continuation of Ser. No. 703,905, Jul. 9, 1976, abandoned.

[51] Int. Cl.[2] ..... H01P 1/22

[52] U.S. Cl. ..... 333/81 R; 343/18 A; 343/909

[58] Field of Search ..... 333/22 R, 81 R, 81 B; 343/18 A, 703, 786

[56] References Cited

U.S. PATENT DOCUMENTS

| | | | |
|---|---|---|---|
| 2,464,006 | 3/1949 | Tiley | 343/18 A |
| 2,870,439 | 1/1959 | Stinehelfer | 343/18 A |
| 2,977,591 | 3/1961 | Tanner | 333/81 R X |
| 2,994,400 | 8/1961 | Heller | 343/18 A X |
| 3,806,943 | 4/1974 | Holloway | 343/703 |
| 3,836,967 | 9/1974 | Wright | 343/18 A |
| 4,050,073 | 9/1977 | Wesch | 333/81 R X |

*Primary Examiner*—Paul L. Gensler

*Attorney, Agent, or Firm*—Freilich, Hornbaker, Wasserman, Rosen & Fernandez

[57] ABSTRACT

A structure with a surface portion of dielectric material which passes electromagnetic radiation and with a portion below the surface which includes material that absorbs the radiation, the face of the structure being formed with numerous steep ridges. The steepness of the dielectric material results in a high proportion of the electromagnetic energy passing through the surface for absorption by the absorbing material under the surface. A backing of aluminum or other highly heat-conductive and reflective material lies under the face and has very steep protuberances supporting the absorbing and dielectric materials.

8 Claims, 11 Drawing Figures

Fig. 1
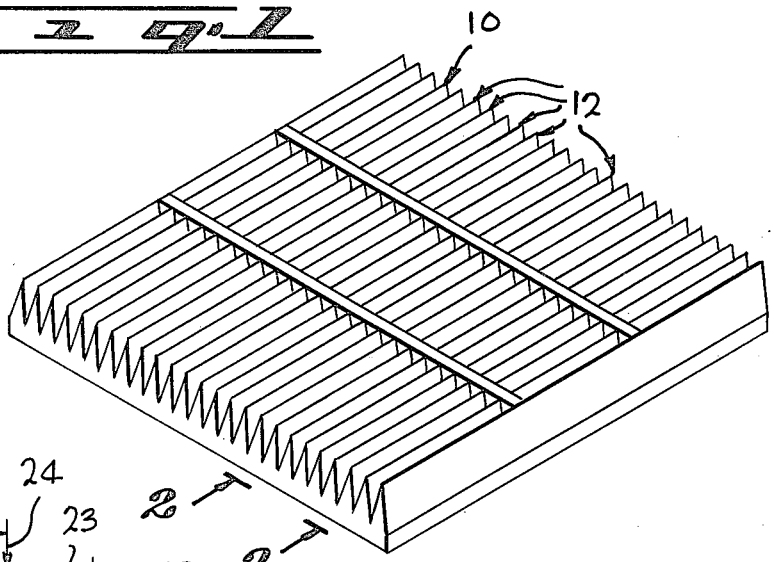
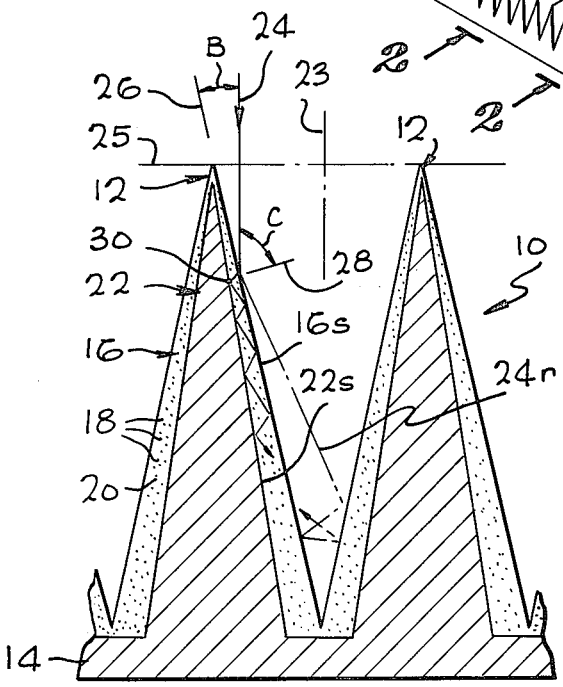
Fig. 2
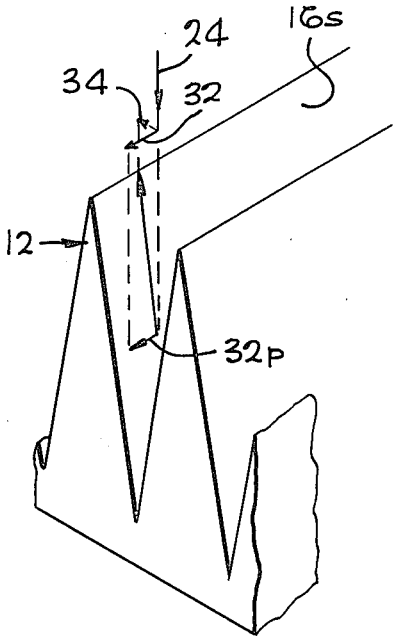
Fig. 3
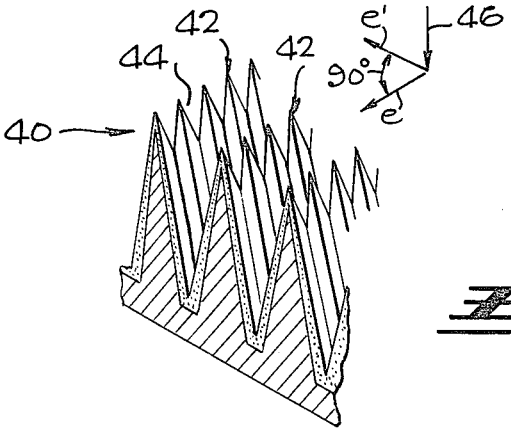
Fig. 4

Fig. 5
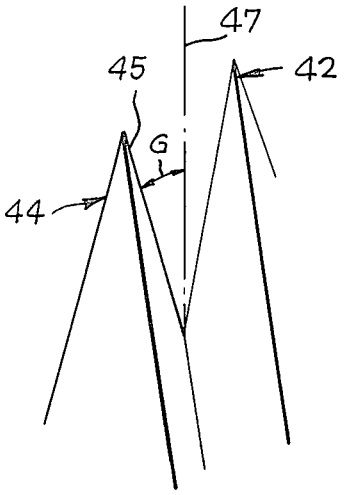
Fig. 7
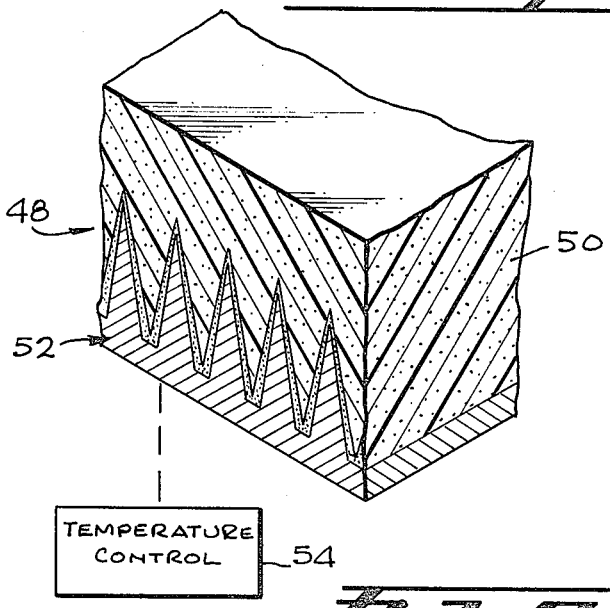
Fig. 6
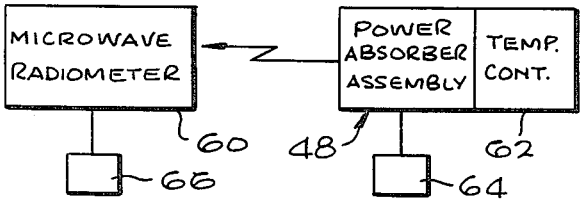
Fig. 9
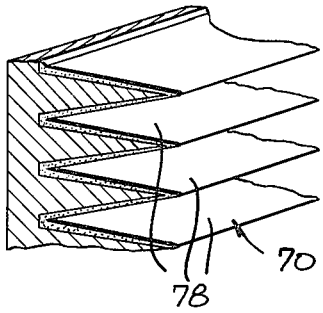
Fig. 8
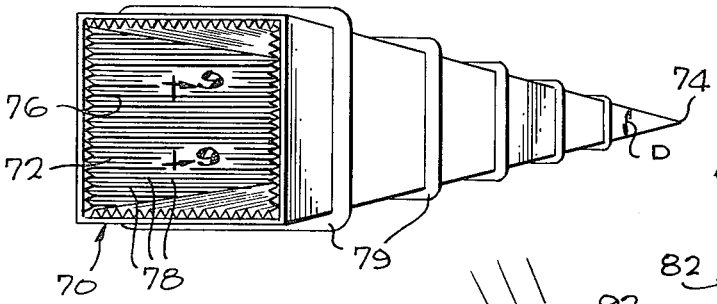
Fig. 10
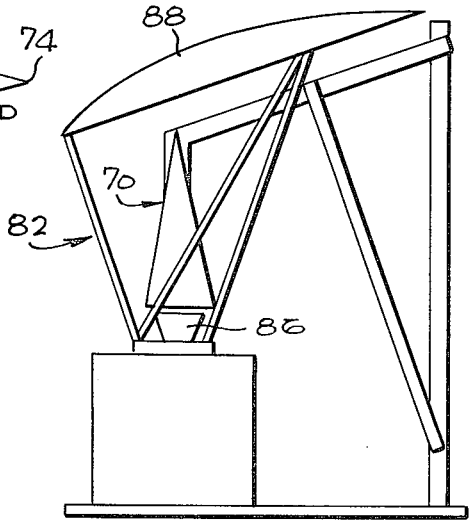
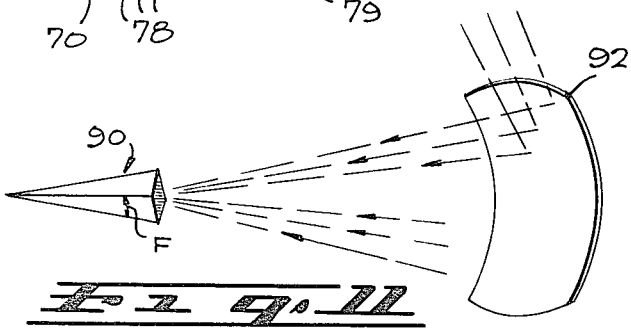
Fig. 11

ELECTROMAGNETIC POWER ABSORBER

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

This is a continuation of application Ser. No. 703,905 filed July 9, 1976, now abandoned.

BACKGROUND OF THE INVENTION

This invention relates to a power absorber for absorbing electromagnetic energy.

Electromagnetic power absorbers are utilized in many applications. For example, microwave radiometer systems can be calibrated by directing the antenna at a structure that absorbs substantially all energy incident thereon and which, conversely, has an emissivity close to that of an ideal black body. An earlier type of power absorber employs a plate with electromagnetic absorbing material, and with shallow pyramid or other projections that aids internal reflection to enhance power absorption. However, the absorptivity of such panels has been considerably less than 100%.

SUMMARY OF THE INVENTION

In accordance with one embodiment of the present invention, a compact power absorber is provided which is highly effective in absorbing electromagnetic radiation. The power absorber is a plate-like structure having a face portion with a plurality of ridges formed of a suspension of particles of energy-absorbing material such as iron, in a dielectric suspending material such as epoxy. Each ridge is steep so that radiation incident normal to the plane of the entire structure impinges on a ridge surface at close to the Brewster angle, at which a very high percentage of the radiation enters the dielectric for absorption by the particles. The structure also includes a plate of highly heat-conductive material such as aluminum, with numerous very steep ridge-like protuberances extending into each of the ridges of the face portion, to aid in providing a uniform temperature throughout the structure and to provide internal reflections that increase the quantity of radiation that is absorbed.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of a power absorber constructed in accordance with one embodiment of the present invention;

FIG. 2 is a partial sectional view taken on the line 2—2 of FIG. 1;

FIG. 3 is a simplified perspective view of a portion of the absorber of FIG. 1;

FIG. 4 is a partial perspective view of a power absorber constructed in accordance with another embodiment of the invention;

FIG. 5 is a view of a portion of the absorber of FIG. 4;

FIG. 6 is a block diagram showing the manner in which a radiometer temperature calibration can be conducted utilizing the power source of the present invention;

FIG. 7 is a partial perspective view of a power absorber constructed in accordance with another embodiment of the invention;

FIG. 8 is a perspective view of a power absorber constructed in accordance with another embodiment of the invention;

FIG. 9 is a view taken on the line 9—9 of FIG. 8;

FIG. 10 is a side elevation view showing how the absorber of FIG. 8 can be utilized to calibrate a radiometer; and FIG. 11 is a perspective view of an energy collecting system, utilizing an absorber of the type illustrated in FIG. 8.

DESCRIPTION OF THE PREFERRED EMBODIMENTS

FIGS. 1-3 illustrate a power absorber 10 in the form of a plate-like structure with numerous steep ridges 12 upstanding from the plane of the structure. The structure includes a backing base or plate 14 of highly heat conductive material, and a coating 16 of material which absorbs electromagnetic radiation. The base 14 can be constructed of aluminum, which is light weight and highly heat conductive. The coating 16 is constructed of particles 18 of radiation-absorbing material such as iron, suspended in a radiation-transmitting dielectric material 20 such as epoxy. When electromagnetic radiation, such as microwaves, is directed at the power absorber, much of the radiation passes into the dielectric 20 where it encounters the radiation-absorbing particles 18.

The power absorber is constructed to maximize the absorption of the incident electromagnetic radiation. To this end, the ridges 12 are made steep and the base 14 is formed with even steeper protuberances 22 that extend into the ridges. Normally, the angle B between a line 23 which is normal to the plane 25 of the structure, is less than 45°. A first requirement for absorbing radiation is that the incident rays pass into the epoxy 20, and conversely that a minimum amount of energy be reflected from the surface. Reflections from the coating 16 are minimized by orienting the surface, such as 16*s* of the coating, so that the angle B between an incident ray 24 and an imaginary line 26 lying on the surface 16*s* (as viewed in the sectional view) is close to a particular angle at which there is no reflection. The angle of incidence can also be defined as the angle C between the incident ray 24 and an imaginary line 28 that is normal to the surface. The angle C at which there is no reflection of radiation is given by the equation:

$$C=\tan^{-1}\sqrt{e_r} \text{ or}$$

$$B=90°-\tan^{-1}\sqrt{e_r}$$

where $e_r$ is the dielectric constant (with respect to air) of the material onto which the ray is incident, and where the electromagnetic radiation is polarized with its electric field parallel to the plane of incidence. For microwave radiation of 50 GHz ($50\times10^9$ Hz) epoxy has a dielectric constant of approximately 20, so that the angle B required to prevent reflections is approximately 12.5°. Where it is desired to absorb microwaves of about 50 GHz, using epoxy as the particle-suspending material 20, the surface 16*s* of the coating is oriented at an angle B of approximately 12.5° from lines normal to the plane of the plate-like structure.

When a microwave 24 is incident on the surface 16s, most of the energy passes into the coating 16 although the wave is refracted in direction closer to the normal, as shown in FIG. 2. The ray then strikes the surface 22s, of the base protuberance 22, at the point 30, the ray then being reflected off the surface 22s. The ray then passes again through the coating, where more energy is absorbed until it is internally reflected from the coating surface 16s. This occurs several times, so that the wave passes a considerable distance through the coating material and a high percentage of the energy is absorbed. The reflected portion 24r of the ray undergoes several reflections between adjacent ridges 12, with some of the energy being absorbed, and with only a small amount of the energy being reflected back out of the power absorber.

The steep protuberances 22 which project into each ridge of the structure, serve two purposes. One purpose is to maintain the coating material 16 at substantially the same temperature as the rest of the structure, to provide a substantially isothermal power absorber. The steep protuberances 22 come progressively closer to the surface 16s of the ridge at locations progressively closer to the tips of the ridges, where the ridges are narrowest and where the temperature can be most rapidly changed by heating or cooling from ambient air. In addition, the steep protuberances 22 provide reflecting surfaces 22s largely parallel to the outer surface 16s of the coating material, but slightly diverging therefrom, to produce numerous internal reflections of radiation that passes into the coating material.

As illustrated in FIG. 3, the steep ridges 12 are effective in absorbing microwaves when the wave is polarized with its electric field indicated by arrow 32, so the electric field is oriented in the plane of incidence of the ridge on which the wave is incident, as indicated by the projection 32p of the arrow 32 onto the ridge surface 16s. However, in many situations, the incident wave has an electric field component, as indicated by arrow 34, which is oriented normal to the plane of incidence. In that case, the corresponding proportion of the wave energy whose electric field is normal to the plane of incidence, will not totally pass into the coating, but instead a considerable proportion will be reflected.

FIGS. 4–5 illustrate a modified power absorber 40 which includes steep ridges 42 with steep grooves 44 therein spaced along the length of the ridges. When a microwave 46 is projected at the power absorber, with the microwave having two polarization components e, e' along the two orthogonal directions in the plane of the wave front, then there will be a high percentage of each polarized energy component. Any polarized component whose electric field is perpendicular to the plane of incidence will be reflected at that surface such that the electric field will also be in the plane of incidence, due to the wedge configuration. The energy which is thus reflected will impinge on a surface complexly oriented so that a large percentage of the energy will then be absorbed. As a result, a high percentage of the incident energy will eventually be absorbed by the power absorber. The angle G formed between the side 45 of each groove and an imaginary line 47 normal to the plane of the structure and which bisects the groove, is less than 45°, and preferably about 12½° for absorbing microwaves of a frequency of a plurality of gigahertzs when using epoxy with a dielectric constant of 20. If the dielectric constant is essentially frequency independent, then the absorber is similarly frequency independent.

FIG. 7 illustrates another embodiment of the invention, wherein a power absorber assembly 48 which includes a thermal insulating covering 50, is utilized to cover the front face portion of a power absorber 52 which may be of the type illustrated in FIG. 1 or FIG. 4. The insulating covering 50 is constructed of a material having a dielectric constant and index of refraction that are substantially the same as air, such as styrofoam. The covering 50 is useful to prevent moisture from condensing on the face portion of the power absorber 52 when its temperature is below the dew point of the ambient atmosphere by refrigerating temperature control apparatus 54. Even though the power absorber 52 may be cooled far below the dew point, the front surface of the covering 50 can be close to ambient temperature to avoid deposition of moisture thereon.

FIG. 6 illustrates a manner in which a power absorber assembly of the invention, such as that shown at 48 in FIG. 7, can be utilized to calibrate a radiometer 60. The power absorber assembly 48 is connected to a temperature control apparatus 62 which can cool (or heat) the power absorber assembly to a desired temperature. A thermocouple 64 is utilized to assure that the assembly is at the desired temperature. Another thermocouple 66 is connected to the radiometer 60 to assure that it is at a desired temperature. The radiometer 60 is positioned so that it "sees" only the black body power absorber assembly 48. The output of the radiometer 60 then represents the thermal noise which it receives when viewing a "black body" at the predetermined temperature at which the power absorber assembly 48 is being maintained.

FIGS. 8 and 9 illustrate a power absorber 70 in the form of a tapered structure with an open end 72 for receiving radiation and an opposite closed end 74. The hornlike power absorber is tapered at a small angle D such as 25°, so that the inner surface 76 extends at a small angle such as 12½° from the axis of the horn. In addition, each surface such as 76 such as plurality of steep recesses 78 to form ridges. The power absorber includes cooling coils 79 for carrying a coolant such as liquid nitrogen. A covering of insulation (not shown) such as sytrofoam, lies about the power absorber. Instead of constructing the horn as a pyramid with four sides, it may be constructed as a cone.

The horn power absorber 70 is useful as a microwave power absorber that is sufficiently compact to be inserted, as shown in FIG. 10, between the feed horn 86 and the scanning parabolic reflector 88 of a microwave antenna structure 82.

The same general horn configuration is useful as a horn electromagnetic power absorber that absorbs sunlight to generate electricity. FIG. 11 illustrates a horn electromagnetic power absorber 90 positioned at the focal point of a sunlight reflector 92 that can be pivoted to constantly reflect sunlight into the horn. The horn has ridges formed of light-to-electricity converter material such as silicon. The electromagnetic power absorber 90 has the same configuration as the power absorber 70 of FIG. 8, except that the angle F of the horn and of each ridge of its inner surface, may be shallower to account for a lower index of refraction of the dielectric material at the frequency of light. Instead of utilizing direct light-to-electricity cells on the horn inner surface, the horn can be used merely to absorb heat, to heat a fluid that circulates through coils similar to the coils 79 in FIG. 8.

Thus, the invention provides an efficient electromagnetic power absorber formed by a structure with a face portion of dielectric material formed at a steep angle. The face portion of the power absorber can be constructed of particles of radiation-absorbing material suspended in a dielectric. A base of highly thermally conductive material can be utilized with protuberances that extend at a slightly steeper angle than the surface of the structure. The face portion can be formed as a series of elongated ridges, and the ridges can be formed with numerous steep grooves. The steepness of the ridges and grooves can be controlled so that the surfaces of the power absorber are oriented at the Brewster angle with respect to the radiation impinging thereon, to cause a high percentage of the radiation to pass into the dielectric where it can be absorbed by the particles. A horn-like power absorber can be formed with ridges extending along the length to serve as an efficient and compact power absorber that can fit over the feed horn of a microwave antenna structure, or which can be utilized with light-to-electricity converters under the dielectric, to capture a high proportion of light concentrated thereon and simultaneously provide a compact heat transfer mechanism to maintain lower temperature operation of the solar cells.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. A power absorber for absorbing electromagnetic radiation comprising:

a plate-like structure having a face portion forming a plurality of ridges upstanding from the plane of the structure, said face portion being formed of a suspension of particles of electromagnetic wave-absorbing material in a dielectric suspending material, each ridge forming steep surfaces oriented at an angle of less than 45° to an imaginary line that is normal to the plane of the plate-like structure;

said structure including a backing plate of highly heat conductive material with a plurality of protrusions extending into said ridges, each protrusion forming a reflecting surface lying behind a surface of a corresponding ridge, with the reflecting surface of the protrusion oriented at a smaller angle than the corresponding ridge surface, to said normal line.

2. The power absorber described in claim 1 including:

a layer of heat insulative material which is substantially transparent to microwaves and which is of approximately the same index of refraction as air, lying over said face portion of said structure.

3. The power absorber described in claim 1 wherein:

said ridges are elongated and extend along said face portion, and each ridge has a plurality of steep grooves spaced along its length, each groove forming a pair of groove faces each oriented at an angle of less than 45° to said imaginary normal line.

4. A power absorber for absorbing electromagnetic radiation comprising:

a plate like structure having a face portion forming a plurality of ridges upstanding from the plane of the structure, said face portion being formed of a suspension of particles of electromagnetic wave-absorbing material in a dielectric suspending material, each ridge forming steep surfaces oriented at an angle of less than 45° to an imaginary line that is normal to the plane of the plate-like structure, said structure including a backing plate of highly heat-conductive material with a plurality of protrusions extending into said ridges;

cooling means coupled to said backing plate to cool it below the ambient temperature; and a layer of heat insulative material which is substantially transparent to microwaves and which is of approximately the same index of refraction as air, lying over said face portion of said structure.

5. An electromagnetic radiation absorber formed of four triangular plate-like structures meeting in a common vertex to form a hollow pyramid open at one end opposite the vertex to receive radiation and closed at the vertex, each of said plate-like structures being inclined at a small angle to the axis of the pyramid, said axis passing through the vertex and the center of the open end, each plate-like structure having a face portion on the inside forming a plurality of parallel ridges upstanding from the plane of the structure, said inside face portion being formed of a suspension of particles of electromagnetic wave-absorbing material in a dielectric suspending material, each ridge forming steep surfaces oriented at an angle of less than 45° to an imaginary line that is normal to the plane of the plate-like structure, and each plate-like structure being oriented with its ridges perpendicular to a side of said open end.

6. An electromagnetic radiation absorber as defined in claim 5 wherein said angle of said plates to the axis of the pyramid and said angle of said ridge surfaces to the imaginary line that is normal to the plane of the plate-like structure of which the ridges are a part are equal to Brewsters angle for the dielectric suspensing material of said face portion of said plate-like structures.

7. An electromagnetic radiation absorber as defined in claim 6 wherein each of said plate-like structures includes a plurality of protrusions extending into said ridges, each protrusion forming a reflecting surface lying behind a surface of a corresponding ridge, with the reflecting surface of the protrusion oriented at a smaller angle than the corresponding ridge surface, to said normal line.

8. A power absorber for absorbing electromagnetic energy comprising:

a backing plate of highly heat-conductive material having a plurality of spaced protruberances on a front face thereof;

a coating comprising a suspension of electromagnetic wave-absorbing particles in a dielectric material, disposed on said protuberances; and each of said protuberances having a steep triangular cross-section, and the coating portion lying on each protuberance having a greater thickness at locations progressively below the top of the protuberance.

* * * * *